US006119374A

United States Patent [19]

Bollard et al.

[11] Patent Number: 6,119,374

[45] Date of Patent: Sep. 19, 2000

[54] BOOT WITH SOLE STIFFENER

[75] Inventors: Patrick Bollard, Veyrier du Lac; Jerome Chaigne, Gruffy; Olivier Dalvy, Saint Felix, all of France

[73] Assignee: Salomon S.A., Metz-Tessy, France

[21] Appl. No.: 09/231,813

[22] Filed: Jan. 15, 1999

[30] Foreign Application Priority Data

Jan. 16, 1998 [FR] France ..... 98 00579

[51] Int. Cl.[7] ..... A43B 5/00

[52] U.S. Cl. ..... 36/117.3; 36/117.5

[58] Field of Search ..... 36/117.3, 117.4, 36/117.5, 115, 103

[56] References Cited

U.S. PATENT DOCUMENTS

| | | | |
|---|---|---|---|
| 3,828,448 | 8/1974 | Leonildo | 36/117.5 |
| 3,922,800 | 12/1975 | Miller et al. | 36/117.5 |
| 4,631,843 | 12/1986 | Annovi | 36/117.5 |
| 5,595,006 | 1/1997 | Perrissoud et al. | 36/117.5 |

FOREIGN PATENT DOCUMENTS

| | | | |
|---|---|---|---|
| 284070 | 9/1988 | European Pat. Off. | 36/117.3 |
| 413135 | 2/1991 | European Pat. Off. | 36/117.3 |
| 2310719 | 12/1976 | France . | |
| 2714800 | 7/1985 | France . | |
| 1785260 | 1/1972 | Germany . | |
| 4121114 | 1/1992 | Germany | 36/117.3 |
| 677587 | 6/1991 | Switzerland | 36/117.3 |

*Primary Examiner*—M. D. Patterson
*Attorney, Agent, or Firm*—Greenblum & Bernstein, P.L.C.

[57] ABSTRACT

A sport boot, of the rigid shell type, provided with an adjustable stiffening device for its sole having a rigid element. The rigid element is mounted freely in a housing of the sole open across from the plantar surface of the user's foot. An adjustable assembly device, inserted in the rigid element and fixed to the sole allows achieving, for an adjustment position, the coupling of the sole to the rigid element. The invention allows modifying the stiffness of the sole, and thus adapting the general behavior of the boot depending on a specific use for which the boot is adapted at a given time.

14 Claims, 5 Drawing Sheets

24
1
4'
8
6
14
13
18
5
2
23
22
II
2'
4
10
20
3
II
17
9
7
19

1
24
III
18'
7
18
4'
4
8
23
14
12
6
5
12
2
17
9
13
11
2'
10
22
III 24
12
17
4
4'
12
19'
18'
19
20
18
2
13
2'
7

15
12
13
4
4'
12
24
18'
20
18
17
2'
7
19'
19

Fig: 5
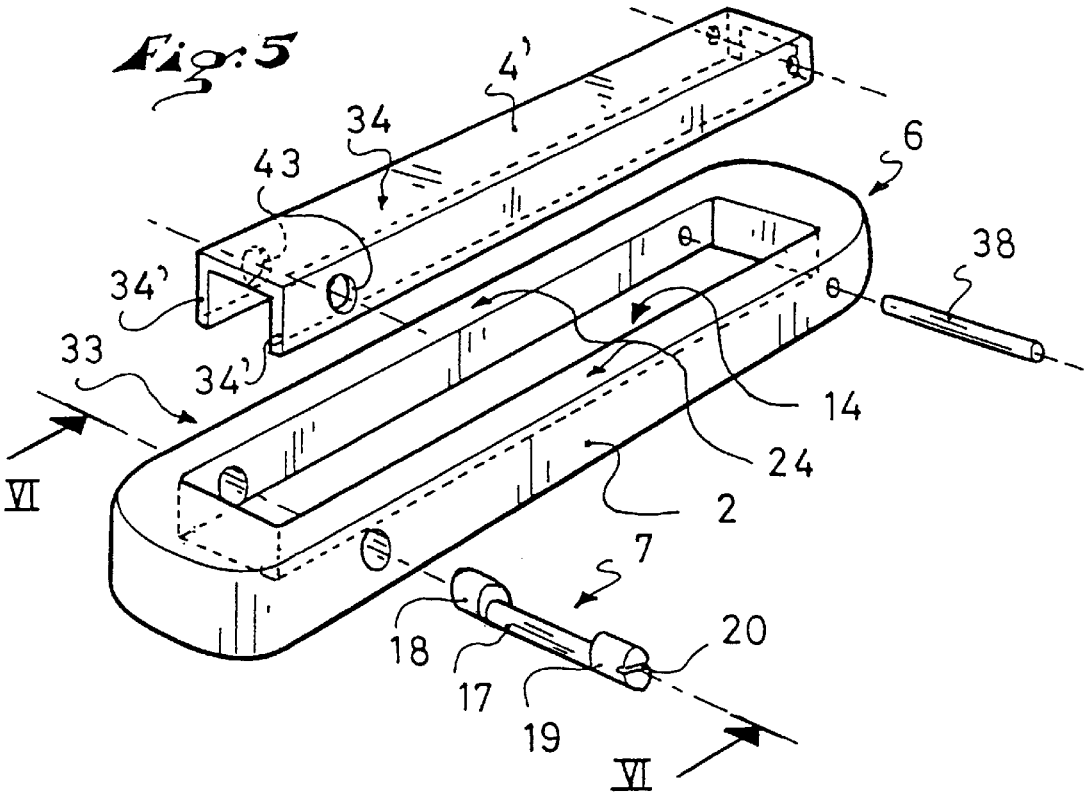
Fig: 6
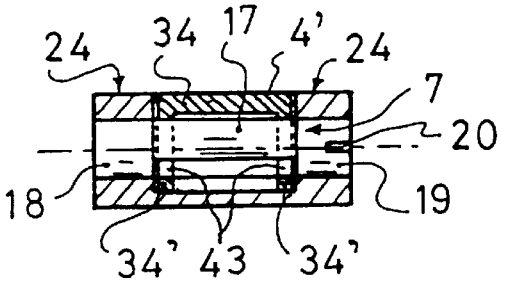
Fig: 7
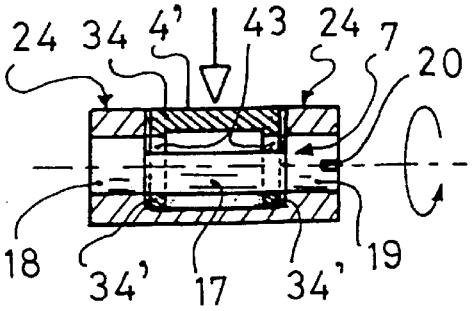
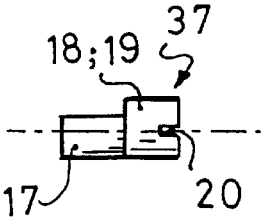
Fig: 8

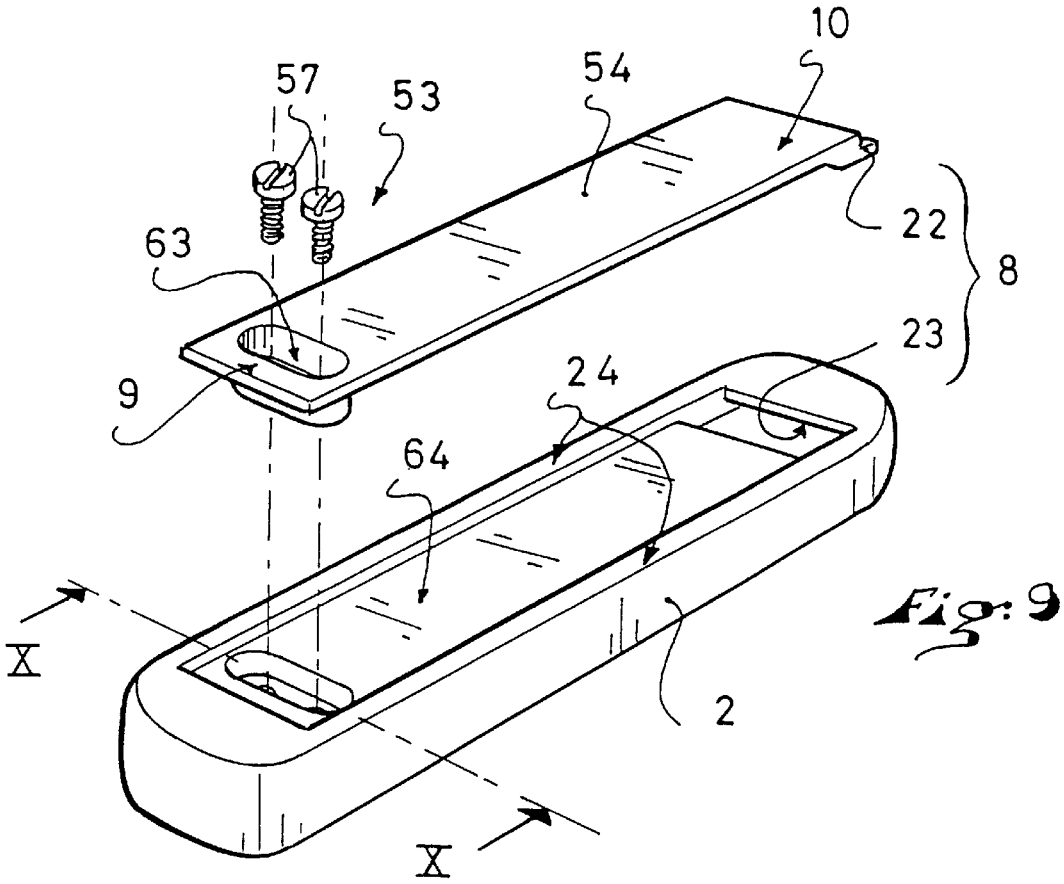
Fig: 9
Fig: 10
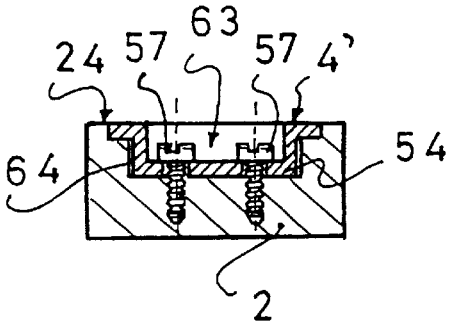
Fig: 11
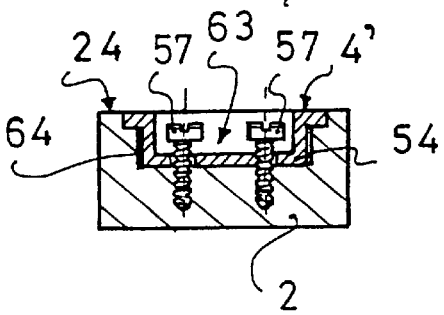

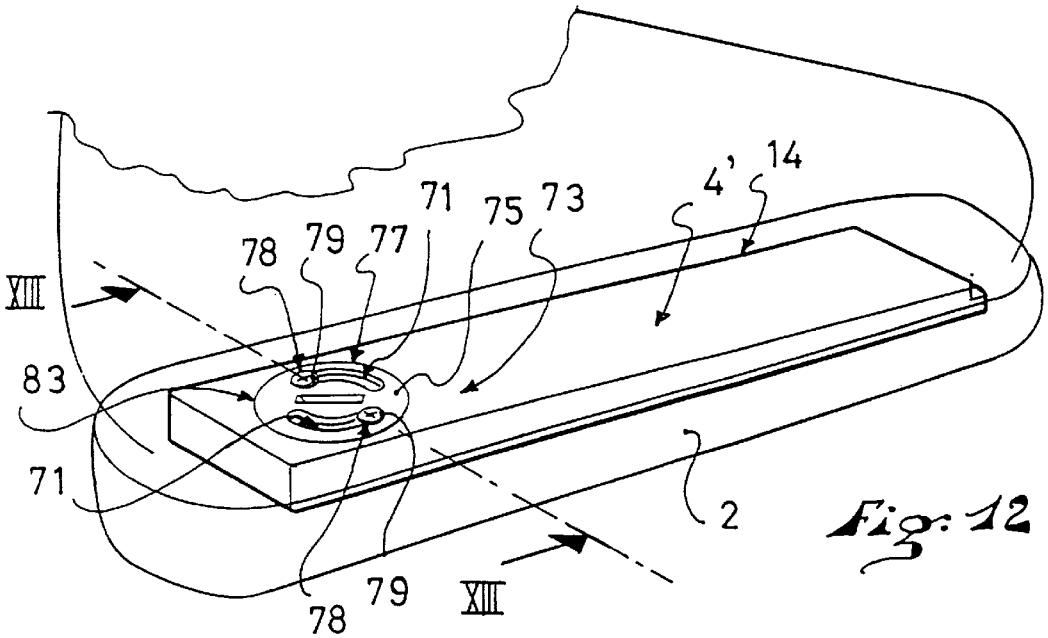
Fig: 12
Fig: 13
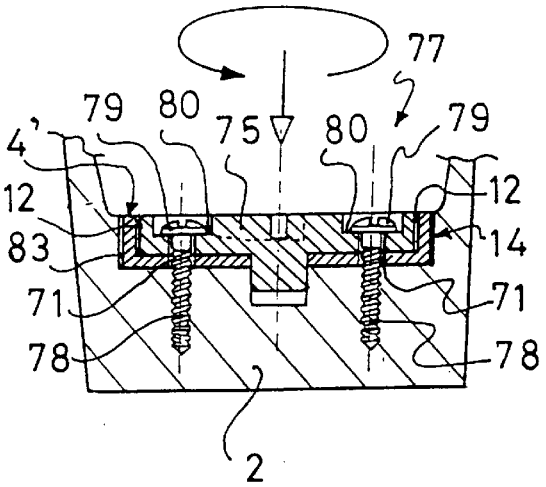
Fig: 14
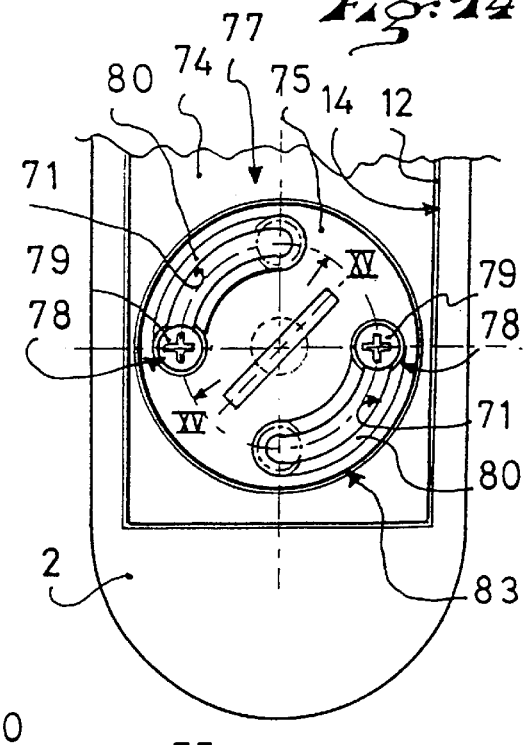
Fig: 15
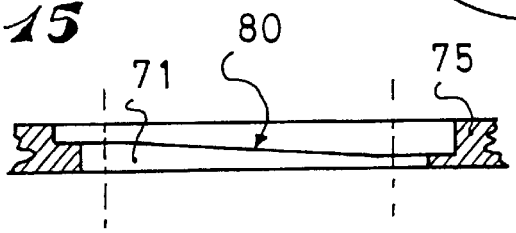

BOOT WITH SOLE STIFFENER

BACKGROUND OF THE INVENTION

1. Field of the Invention

The present invention relates to a sport boot of the so-called "stiff shell" type and to an adjustable stiffening device adapted to modify the characteristics of the boot sole, particularly in its longitudinal direction, so as to adapt the general stiffness of the boot and therefore its behavior, for a specific use, especially when it is fixed on an equipment or accessory, such as, for example, a ski, a skate, spikes, etc., necessary for certain athletic practices.

2. Description of Background and Material Information

The known sport boots of the aforementioned type, such as those described in French Utility Certificate No. 2 391 666, French Patent Publication No. 2 310 719, and French Patent Publication No. 2 714 800 have adjustable stiffening devices which consist of integrating into the sole or retaining therein at least one rigid element so as to modify the stiffness of the sole and, consequently, the general stiffness of these boots.

More specifically, these stiffening devices have at least one removable rigid element that extends in the longitudinal direction of the sole, and at least one means for assembling the element to the sole adapted to join them in order to achieve their coupling. In these boots, it is also taught that the adjustment of their stiffness can occur by replacing, in the sole, a rigid element having a given stiffness with another rigid element having a different stiffness.

These ways of modifying the stiffness of soles, and thus of boots, give full satisfaction as to the result but still require a mounting-dismounting operation for at least one assembly means, as well as the removability of at least one rigid element with respect to the sole, whether it is to weaken or reinforce the latter. Consequently, depending on the adjustment made, the user is obligated to provide a storing area that is not integrated with the boot, for the rigid element that is not used or for the removable rigid element having characteristics that are different from the one implemented and adapted to replace the latter in the case of a particular use of the boot.

Obviously, in certain examples of construction of these stiffening devices, as seen in their description in documents FR 2 310 719 and FR 2 714 800, it suffices to remove the assembly means to couple the rigid element to or release it from the sole through the interior of the boot, and thus to modify the stiffness of the sole without manipulating the rigid element. However, in this possibility, it is then necessary to provide a storing for the assembly means which is dismounted from the sole.

SUMMARY OF THE INVENTION

An object of the present invention is to overcome the aforementioned drawbacks relative to the tedious operations of mounting-dismounting and/or storing the elements that are not used, whether these are the rigid elements or the assembly means of the stiffening devices.

Another object of the invention is to propose a stiffening device that is relatively easy to reach in order to be adjusted, on the one hand, and protected from exterior dirt and wear resulting from using the boot, especially when walking, on the other hand.

Furthermore, an object of the invention is to allow a simultaneous adjustment of the transverse stiffness of the sole with an adjustment of the longitudinal stiffness thereof.

Finally, another object of the invention is to optimize the manufacturing costs by providing a stiffening device in which at least one rigid element constitutes the internal sole on which the plantar surface of the user's foot takes support.

To achieve these objects, the sport boot of the rigid shell type is provided with an adjustable stiffening device, adapted to modify the characteristics of the sole, which has one rigid element extending in the longitudinal direction of the sole and at least one means for assembling the latter to the sole.

More particularly, the rigid element of the stiffening device is freely mounted in a housing made in the sole, this housing being open on the inside of the boot across from the plantar surface of the user's foot.

Thus, the stiffening device is relatively well-protected from the exterior dirt and possible wear that can come from walking. It is also characterized in that at least one assembly means is provided to be adjustable in order to intervene between the rigid element and the sole, from a blocking position where it solidly connects them by achieving their coupling to an unblocking position where it leaves them free to move for the value of a certain clearance left between them.

Advantageously, the adjustable assembly means is located in the zone of the heel of the sole and another assembly means, fixed or equally adjustable, is implemented in the zone of the tip of the sole. In this way, the rigid element can be coupled to the sole in the longitudinal direction thereof at least in two spots.

According to one characteristic, the adjustable assembly means is completely inserted into the rigid element through a recess of the latter, and is fixed on at least one of the walls of the sole contiguous to the rigid element where it remains engaged regardless of its adjustment position.

Through these arrangements, the rigid element and at least the means for assembling the stiffening device remain continuously mounted in the boot sole during the operation of adjusting the stiffness thereof. Furthermore, since the assembly means is embedded in the thickness of the rigid element, due to its insertion in a recess of the latter, changing its adjustment position causes no modification in the fitting volume of the boot, especially across from the plantar surface of the user's foot.

According to an embodiment, the rigid element is of a generally parallelepipedic shape and extends approximately from the zone of the heel to the zone of the tip of the sole, at least one of its ends, located in correspondence with these zones, cooperating with an adjustable assembly means. In this way, the rigid element is capable of stiffening the boot sole in its longitudinal direction and practically over its entire length. Given its width, it is also susceptible of stiffening the sole in its transverse direction.

Advantageously, the rigid element has a relatively planar surface on the inside of the boot across from the plantar surface of the user's foot and constitutes, at least partially, the internal sole of the boot. Of course, the recess in which the assembly means is inserted is determined depending on the variations from the blocking position to the unblocking position of the latter with respect to the planar surface of the rigid element which serves as a support for the user's foot. More specifically, the assembly means still remains located on this side of this planar surface, whether it is centered vertically or transversely to the rigid element that it traverses to then be engaged in the sole.

BRIEF DESCRIPTION OF DRAWINGS

The invention will be better understood and other characteristics will become apparent with reference to the following description and the attached schematic drawings showing, by way of example, several possible embodiments.

FIG. 5 shows a second embodiment of an adjustable stiffening device, seen in an exploded perspective view, and FIGS. 6 and 7 show, in a transverse cross-sectional view taken along the line VI—VI of FIG. 5, a blocking and unblocking position, respectively;

FIG. 8 shows an alternative embodiment of an assembly means of the stiffening device of FIG. 5;

FIGS. 9, 10, and 11 show a third embodiment of an adjustable stiffening device, FIGS. 10 and 11 being cross-sectional views taken along line X—X of FIG. 9, showing the blocking and unblocking position;

FIGS. 11, 12, 13, and 14 show a fourth embodiment of an adjustable stiffening device, FIG. 13 showing the stiffening device, seen in a cross-sectional view taken along line XIII—XIII of FIG. 12, in a blocking position, and FIG. 14 showing it as seen in a top view;

FIG. 15 is a cross-sectional view taken along line XV—XV of FIG. 14 showing a detail of the means for assembling the stiffening device;

DETAILED DESCRIPTION OF THE INVENTION

Figure 1:
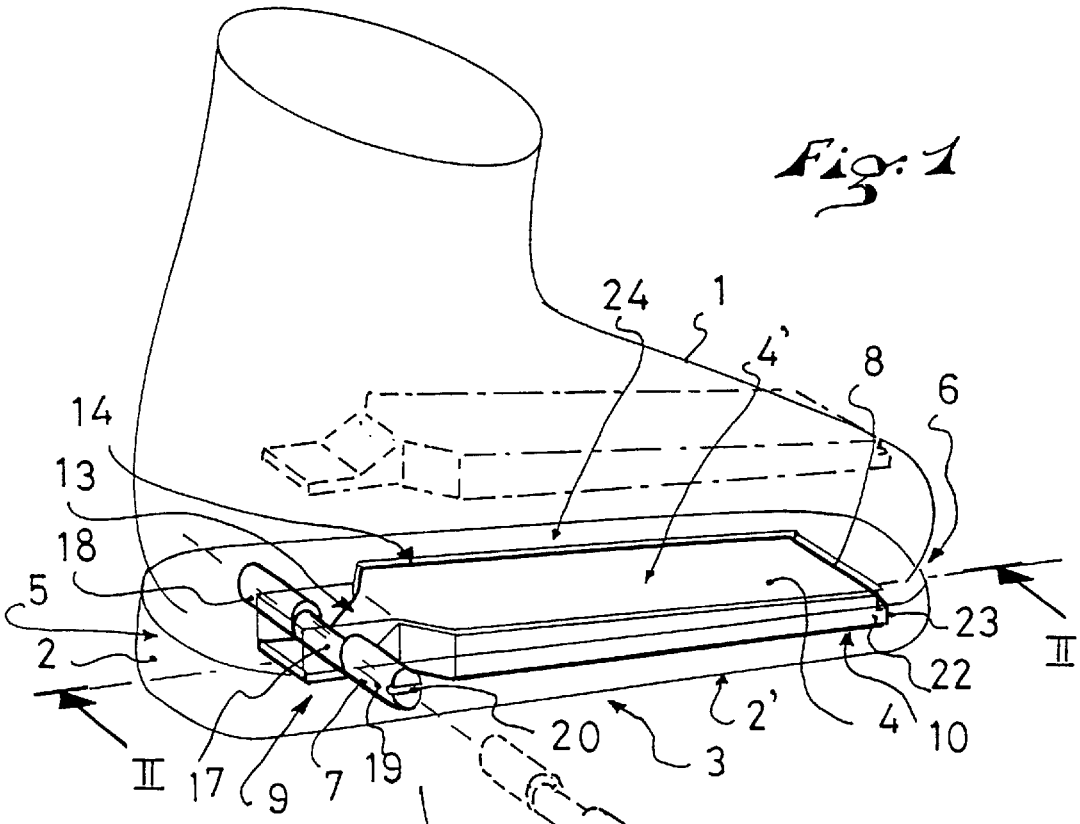
FIG. 1 shows, schematically and in a perspective view, a boot whose sole is provided with an adjustable stiffening device according to a first embodiment.
Figure 2:
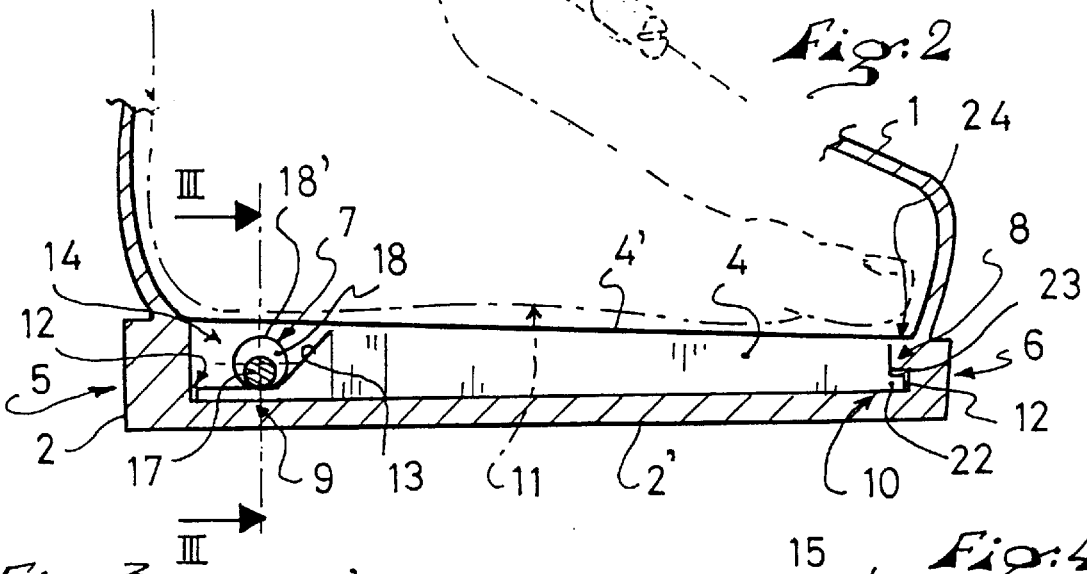
FIG. 2 is a partial longitudinal cross-sectional view of the boot of FIG. 1 taken along line II—II.

The sport boot schematically shown in FIGS. 1 and 2 has a rigid shell 1 and a sole 2, shown according to their outlines, and is provided with an adjustable stiffening device 3 that is integrated into its sole 2.

This device has, on the one hand, a rigid element 4 of a generally parallelepipedic shape that extends in the longitudinal direction of the sole 2, approximately from the zone of the heel 5 to the zone of the tip 6 and, on the other hand, a first assembly means 7 and a second stationary assembly means 8, these means 7 and 8 cooperating with the rear 9 and front 10 ends of the rigid element 4 and the sole 2.

According to the invention, the rigid element 4 is introduced in a housing 14 made in the sole 2 on the inside of the boot where the user's foot is housed. For this reason, it is a stationary assembly means 8, i.e., non-adjustable, that is preferably implemented in the zone of the tip 6 of the sole since this zone 6 is difficult to access from the inside, which is not the case for the zone of the heel 5.

This stationary assembly means 8 consists of, in this example, a nesting of a portion 22 forming a tenon in a portion 23 forming a slot. Of course, this stationary assembly means 8 can be replaced by another adjustable assembly means 7 or by other means, such as screws, for example, that can pass through the sole 2 from the outside, starting at the walking surface 2' thereof.

Figure 3:
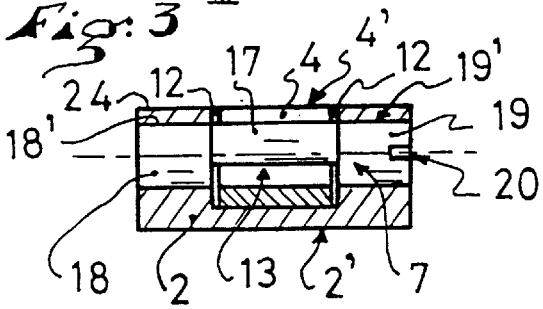
FIGS. 3 and 4 show the sole of the boot of FIG. 2, in a transverse cross-sectional view taken along line III—III, with the unblocked stiffening device in FIG. 3 and the blocked stiffening device in FIG. 4.
Figure 4:
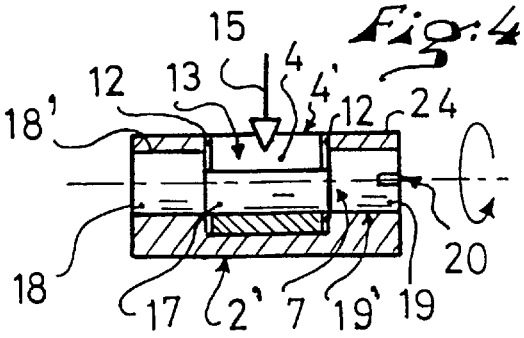

The housing 14, open on the inside of the boot across from the plantar surface 11 of the user's foot (shown in dotted lines in FIG. 2), is made in the thickness of the sole 2 to freely receive the rigid element 4. Thus, as seen in FIGS. 2, 3, and 4, the outline of the housing 14 is provided substantially larger than the outline of the rigid element 4 so that a certain clearance 12 remains between them in the transverse and longitudinal direction. On the contrary, in the vertical direction, the housing 14 is preferably adjusted to the thickness of the rigid element 4 such that the upper surface 4' thereof, which is directed opposite the plantar surface 11 of the user's foot, is substantially at the same level as the horizontal portion 24 of the sole 2 surrounding it and on which the foot rests. Therefore, the rigid element 4 constitutes the equivalent of a rigid internal sole.

According to one characteristic, the adjustable assembly means 7 cooperates between the rigid element 4 and the sole 2 by being completely inserted through a recess 13 of the rigid element 4 and is fixed on the sole 2 where it takes support to apply itself on the rigid element 4, in a blocking position, along a vertical direction 15 directed from the top downwardly as indicated in FIG. 4.

In this embodiment, the adjustable assembly means 7 is constituted by a cylinder having an off-centered cylindrical portion 17 located between its two ends 18, 19 which are engaged in corresponding bearing blocks 18', 19', made in the sole 2 on both sides of the housing 12 in which the rigid element 4 is introduced. In fact, the adjustable assembly means 7 is centered transversely to the rigid element 4, and one of its ends 18, 19, is provided with a handling means 20, such as a screwdriver slot, accessible from the outside, on a flank of the sole 2. It is noted that this lateral arrangement of the handling means 20 of the assembly means 7 relatively limits the risks of wear of the latter that can result from using the boot when walking, and is of an easy accessibility requiring no previous handling or operation, such as removing or opening the boot to modify the general stiffness of the sole 2.

More specifically, it suffices to turn the adjustable assembly means 7 180° to move it from a blocking position, shown in FIG. 4, where its off-centered bearing surface 17 presses down on the bottom of the recess 13 of the rigid element 4, to an unblocking position, shown in FIG. 3, where its off-centered bearing surface 17 is spaced from the bottom of the recess 13. It is furthermore noted that for one or another of the adjusting positions of the adjustable assembly means 7, the latter remains inserted into the rigid element 4 on this side of its upper surface 4', and that the relative position of the rigid element 4 with respect to its housing 14 in the sole 2 remains constant. Thus, the adjustment of the general stiffness of the sole 2 causes no modification of the fitting volume of the boot.

In this embodiment of the adjustable device 3, the stationary assembly means 8 consists of a nesting over the entire width of the front end 10 of the rigid element 4, and the adjustable assembly means 7 acts, in a blocking position, over a great width of the rear end 9 of the rigid element 4, by means of its off centered cylindrical bearing surface 17.

Consequently, the adjustable stiffening device 3 is capable, on the one hand, of providing a substantial rigidity of the sole 2 both in the longitudinal direction as well as in the transverse direction when its rigid element 4 is coupled thereto and, on the other hand, of tolerating a certain general deformability of the sole 2 when the rigid element 4 is free to move transversely in the housing 14 of the latter for a value of the predetermined clearance 12.

In the unblocking position, the rigid element 4 is also free to move in the vertical direction with respect to the housing 14 due to the free space left between its recess 13 and the off-centered cylindrical bearing surface 17 of the adjustable assembly means 7.

In the second embodiment shown in FIGS. 5, 6, and 7, the adjustable stiffening device 33 differs from the stiffening device 3 shown in the preceding FIGS. 1–4 by the shape given to the rigid element 34 with its recess 43, and by its stationary assembly means 38 which is located in the zone of the tip 6 of the sole 2.

More specifically, the rigid element 34 is constituted by a "U"-shaped section mounted upside down so that its horizontal portion between its arms 34' has an upper surface 4' that extends to the area of the horizontal portion 24 of the sole 2 surrounding it and on which the user's foot rests. In this construction, its recess 43, in which the adjustable assembly means 7 is inserted, is formed by a boring corresponding to the cylindrical ends 18 and 19 of the assembly means 7. As for the stationary assembly means 38, it consists of a pin mounted transversely in the sole 2 and the arms of the rigid element 34.

Given that the rigid element 34 is cleared out in its middle, i.e., between the two arms 34' of its "U"-shaped section, it is possible to implement an adjustable assembly means 37, shown in FIG. 8, on each arm 34'. In this case, each adjustable assembly means 37, as shown in FIG. 8, can be constituted by half of the previously described adjustable assembly means 7 and have a cylindrical bearing surface 18 or 19 with a partial off-centered cylindrical bearing surface 17 to be engaged only with one single arm 34', it being understood that each cylindrical bearing surface 18 and 19 is then provided with a handling means 20. This alternative construction, not shown, offers the possibility of modifying the general stiffness of the sole 2 in the longitudinal and transverse direction as previously described, but with an additional adjusting possibility allowing to differentiate the transverse stiffness from one flank to the other of the sole 2, in the area of two adjustable assembly means 37. This possibility is offered by placing only one of the two adjustable assembly means 37 in a blocking position.

According to a third embodiment, shown in FIGS. 9, 10, and 11, the adjustable stiffening device 53 is provided with two adjustable assembly means 57 centered vertically on the zone of the heel 9 of the rigid element 54, and with a stationary assembly means 8 of the tenon 22-slot 23 type transverse to the zone of the tip 10 of the rigid element 54. The latter 54 is mounted in a housing 64 made in the sole 2, taking into account its thickness, so that its upper surface 4' is in the area of the horizontal portion 24 of the sole 2, which serves as a reference for determining the position of the surface on which the user's foot rests.

As in the preceding embodiments, the rigid element 54 is obtained with a recess 63 in which the adjustable assembly means 57 are inserted and at the bottom of which the latter are applied against the sole 2 in a blocking position, seen in FIG. 10, along a vertical direction directed from the top downwardly. In fact, in this illustrated construction, the recess 63 belongs to a cup which penetrates, given its depth, into a corresponding clearance 51 of the sole 2. As shown more specifically in FIGS. 10 and 11, the adjustable assembly means 57 which, in this example, consists of mere screws, remain located on this side of the upper surface 4' of the rigid element 54, whether they are in a blocking or unblocking position.

According to a fourth embodiment of the adjustable stiffening device 73, shown in FIGS. 12–15, the adjustable assembling means 77 implemented with the rigid element 74 consists of a turning lock system 75 cooperating with two retaining and tightening members 78 which are fixed in the sole 2. The turning lock 75, located in a recess 83 of the rigid element 74, is especially obtained with two circular slots 71 that are opposing with respect to the rotational axis of the lock 75 and that extend over an arc of a 90° circle, and through which the retaining and tightening members 78 pass. These slots each have a circular ramp 80, shown in cross section in FIG. 15, on which the head 79 of each retaining and tightening member 78 takes support.

Thus, when a quarter turn is made with the turning lock 75, the circular ramps are pressed under the heads 79 of the retaining members 78 for a position that corresponds then to a blocking position of the rigid element 74 with the sole 2, and are disengaged from the heads 79 of the retaining members 78 for the other position, at 90° from the first, which corresponds to the unblocking position. *Therefore, in this embodiment as in the preceding cases, there is no relative displacement of the rigid element 74 with respect to the sole 2 in this embodiment, and it is the adjusting of the position of the adjustable assembly means 77 that allows the rigid element 74 to move freely in the housing 14 of the sole 2 for the value of the predetermined clearance 12.

It is clear that changes can be made to these different embodiments which are given by way of example.

For example, the rigid element 4, 34, 54, 74 of the adjustable stiffening devices 3, 33, 53, 73 can be connected to the sole 2 only through adjustable assembly means 7, 37, 57, 77, i.e., without implementing stationary assembly means.

Further, the rigid element 4, 34, 54, 74 can have forms other than those just described, such as a solid, hollow, or open section, and can extend longitudinally only over a portion of the length of the sole. Also, it can be of a reduced width or, for example, simply constituted of a cylinder.

Finally, the adjustable assembly means can be provided only at the tip 6 or at the heel 5 of the sole 2.

Figure 16:
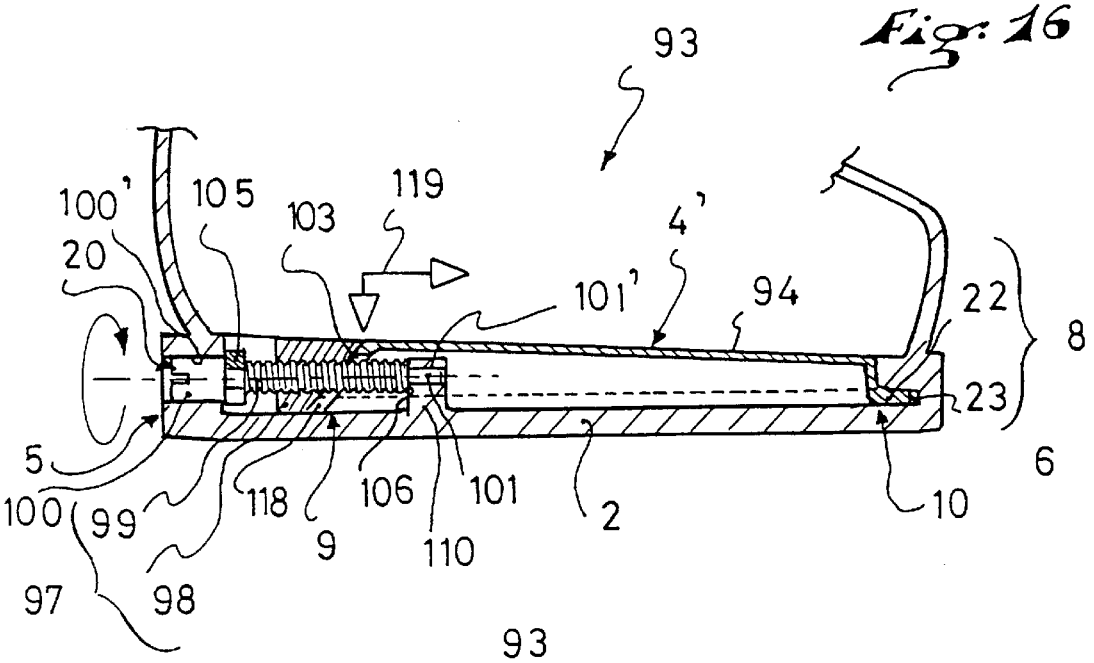
FIGS. 16 and 17 show a fifth embodiment of an adjustable stiffening device.
Figure 17:
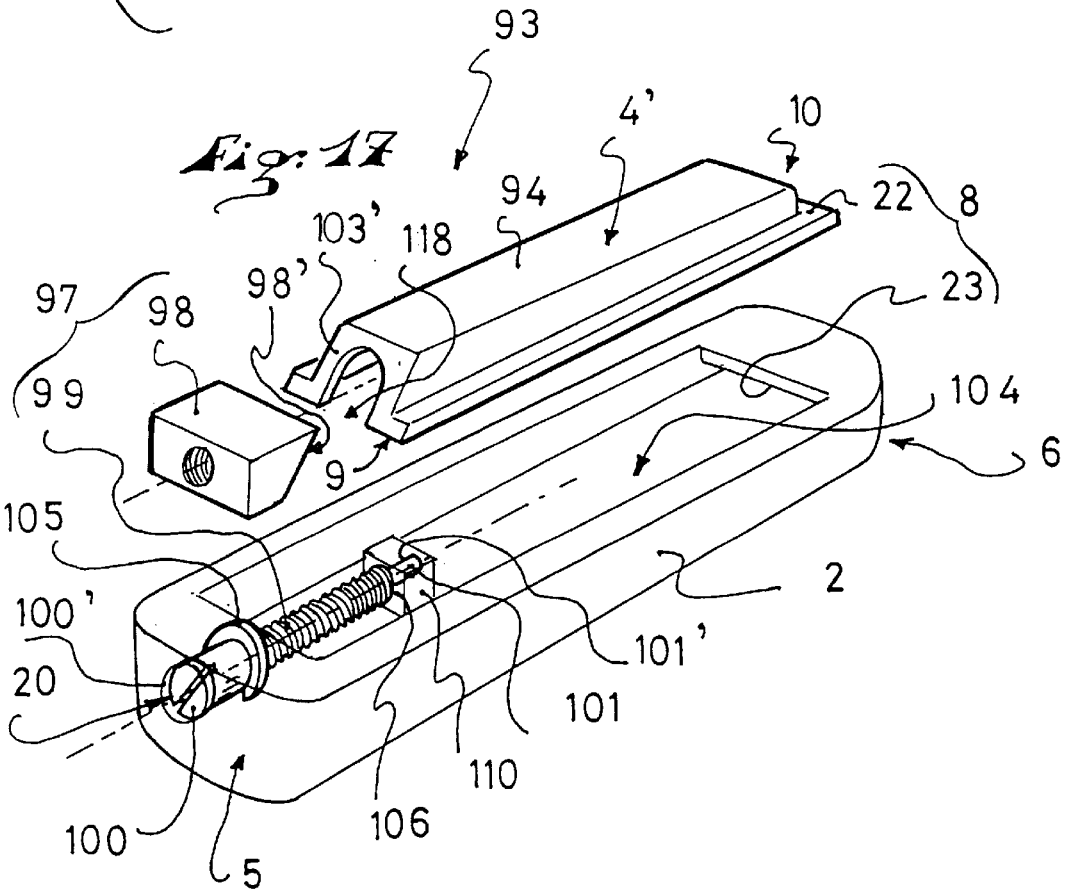

FIGS. 16 and 17 show a fifth embodiment of an adjustable stiffening device 93 in which the adjustable assembly means 97 has a stop 98 that is displaceable over a threaded piece 99 in the direction of the rigid element 94 on the side of a recess 103 with which the latter is provided. This recess 103 is demarcated by a tilted surface 103' against which it is blocked in a given adjustment position.

The adjustable assembly means 97 is inserted in the recess 103 and is fixed on the sole 2 by means of the threaded piece 99. The latter has its two ends 100, 101 retained in corresponding bearings 100', 101', obtained in the sole 2, the one, 100', in the wall of the heel 5 of the sole, and the other, 101', in a projection 110 made in the housing 104 where the rigid element 94 is mounted. In order to leave room for this projection 110, the rigid element 94 is provided with an empty space in the area located across from the projection 110, which is advantageously obtained by using a "U"-shaped section as in the embodiment described in FIG. 5.

According to certain characteristics, the rigid element 94 has a planar surface 4' on the inside of the boot and constitutes, at least partially, the internal sole. It is retained through its end 10 in the zone of the tip 6 of the sole 2 by means of a stationary assembly means 8, consisting of a nesting of the tenon 22 slot 23 type, and through its end 9 in the zone of the heel 5 by means of an adjustable assembly means 97, via the stop 98 provided with a bevel 98' to act as a blocking wedge on the tilted surface 103' that demarcates the rigid element 94 on the side of its recess 103.

The bevel 98' of the stop 98 is oriented so as to overlap the tilted surface 103' from the top downwardly, and the threaded piece 99 is blocked in translation with respect to the sole 2 through its two ends 100, 101, by a lock ring 105 and by a shoulder 106, respectively. In such a construction, the coupling of the rigid element 94 to the sole 2 is a result of a substantial thrust from the stop 98, as indicated by the arrow 119, in the direction of the tip 6 of the sole 2, which consequently forces the latter in its longitudinal direction and, due to the bevel 98' applied on the tilted surface 103' of the rigid element 94, simultaneously produces a force that tends to press the latter to the bottom of the housing 104. The adjustable stiffening device 93 thus allows, depending on the tightening force applied to the handling means 20, to place the sole 2 in a greater of lesser state of tension without changing the relative position of the rigid element 94 with respect to its housing 104.

According to a construction detail, the rigid element 94 is provided with an opening 118 shaped like an inverted "U" on the side where the threaded piece 99 of the adjustable assembly means 97 passes. Thus, it is very easy to mount or dismount the rigid element 94.

The instant application is based upon the French priority patent application No. 98 00579, filed Jan. 16, 1998, the disclosure of which is hereby expressly incorporated by reference thereto in its entirety, and the priority of which is hereby claimed under 35 USC 119.

What is claimed is:

1. A sport boot comprising:

a shell surrounding some portion of a sole;

said sole comprising a sole surface having a recess opening which opens into said sole surface;

said recess opening being defined by an area which is smaller than an area of said sole surface;

a longitudinal rigid stiffening device extending substantially between a heel area and a tip area of said sole;

said stiffening device being located within said recess and having a surface which is either below or substantially corresponds to said sole surface; and a mechanism for adjustably retaining at least one end of said stiffening device within said recess, said mechanism including at least a stiff sole position and a loose sole position, wherein the stiffening device comprises an other end which is retained within said recess, the other end comprising a tenon which engages a slot in the sole, and wherein said stiff sole position is defined by an inability of said stiffening device surface to substantially move with respect to said sole surface and wherein said loose sole position is defined by an ability of said stiffening device surface to move some amount with respect to said sole surface.

2. The sport boot of claim 1, wherein the surface of the stiffening device is substantially planar.

3. The sport boot of claim 1, wherein a relative position of the surface of the stiffening device with respect to the sole surface remains substantially constant between the loose sole position and the stiff sole position when the sole is in a static non-bent position.

4. The sport boot of claim 1, wherein the stiffening device comprises a generally parallelepipedic shape.

5. The sport boot of claim 1, wherein the mechanism is configured to force the at least one end of the stiffening device against a bottom surface of the recess when the mechanism is in the stiff sole position.

6. The sport boot of claim 5, wherein the mechanism extends into a surface of the stiffening device, said mechanism further comprising a moveable stop having internal threads which engage external threads of a threaded piece, said threaded piece having first and second ends such that each of said first and second ends rotatably mounted in the sole.

7. The sport boot of claim 6, wherein the stop comprises a beveled surface which engages a corresponding beveled surface of the stiffening device.

8. The sport boot of claim 5, wherein the mechanism is disposed in the sole and is configured to be adjustable from a position which is exterior to the sport boot.

9. The sport boot of claim 8, wherein the mechanism comprises a cylinder having an off-centered cylindrical bearing surface located between two ends of said cylinder, each of said two ends rotatably disposed in an aperture disposed in the sole and wherein the mechanism further comprises a slot disposed on at least one end of the cylinder.

10. The sport boot of claim 5, wherein the mechanism is configured to force the at least one end of the stiffening device against a bottom surface of the recess using at least one tightening member.

11. The sport boot of claim 10, wherein the mechanism further comprises a turning lock which is rotatable with respect to the at least one tightening member.

12. A sport boot comprising:

a shell surrounding some portion of a sole;

said sole comprising a sole surface having a recess opening which opens into said sole surface;

said recess opening being defined by an area which is smaller than an area of said sole surface;

a longitudinal rigid stiffening device extending substantially between a heel area and a tip area of said sole;

said stiffening device being located within said recess and having a surface which is either below or substantially corresponds to said sole surface; and a mechanism for adjustably retaining at least one end of said stiffening device within said recess, said mechanism including at least a stiff sole position and a loose sole position, wherein the mechanism extends into a surface of the stiffening device, said mechanism further comprising a moveable stop having internal threads which engage external threads of a threaded piece, said threaded piece having first and second ends such that each of said first and second ends is rotatably mounted in the sole, wherein the stop comprises a beveled surface which engages a corresponding beveled surface of the stiffening device, wherein the mechanism is configured to force the at least one end of the stiffening device against a bottom surface of the recess when the mechanism is in the stiff sole position, and wherein said stiff sole position is defined by an inability of said stiffening device surface to substantially move with respect to said sole surface and wherein said loose sole position is defined by an ability of said stiffening device surface to move some amount with respect to said sole surface.

13. A sport boot comprising:

a shell surrounding some portion of a sole;

said sole comprising a sole surface having a recess opening which opens into said sole surface;

said recess opening being defined by an area which is smaller than an area of said sole surface;

a longitudinal rigid stiffening device extending substantially between a heel area and a tip area of said sole;

said stiffening device being located within said recess and having a surface which is either below or substantially corresponds to said sole surface; and a mechanism for adjustably retaining at least one end of said stiffening device within said recess, said mechanism including at least a stiff sole position and a loose sole position, wherein the mechanism is disposed in the sole and is configured to be adjustable from a position which is exterior to the sport boot, wherein the mechanism comprises a cylinder having an off-centered cylindrical bearing surface located between two ends of said cylinder, each of said two ends rotatably disposed in an aperture disposed in the sole and wherein the mechanism further comprises a slot disposed on at least one end of the cylinder, wherein the mechanism is configured to force the at least one end of the stiffening device against a bottom surface of the recess when the mechanism is in the stiff sole position, and wherein said stiff sole position is defined by an inability of said stiffening device surface to substantially move with respect to said sole surface and wherein said loose sole position is defined by an ability of said stiffening device surface to move some amount with respect to said sole surface.

14. A sport boot comprising:

a shell surrounding some portion of a sole;

said sole comprising a sole surface having a recess opening which opens into said sole surface;

said recess opening being defined by an area which is smaller than an area of said sole surface;

a longitudinal rigid stiffening device extending substantially between a heel area and a tip area of said sole;

said stiffening device being located within said recess and having a surface which is either below or substantially corresponds to said sole surface; and a mechanism for adjustably retaining at least one end of said stiffening device within said recess, said mechanism including at least a stiff sole position and a loose sole position, wherein the stiffening device comprises an other end which is retained within said recess, the other end comprising one of a tenon which engages a slot in the sole and a pin which pivotally mounts the stiffening device to the sole, and wherein said stiff sole position is defined by an inability of said stiffening device surface to substantially move with respect to said sole surface and wherein said loose sole position is defined by an ability of said stiffening device surface to move some amount with respect to said sole surface.

* * * * *